US006415445B1

(12) United States Patent
Nishijima et al.

(10) Patent No.: US 6,415,445 B1
(45) Date of Patent: Jul. 9, 2002

(54) SPORTS GLOVE

(75) Inventors: Konosuke Nishijima; Tetsu Soma; Satoshi Yoshida, all of Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/663,289

(22) Filed: Sep. 15, 2000

Related U.S. Application Data

(63) Continuation of application No. PCT/JP99/07308, filed on Dec. 24, 1999.

(30) Foreign Application Priority Data

Jan. 18, 1999 (JP) ..... 11-008921
Dec. 10, 1999 (JP) ..... 11-351334

(51) Int. Cl.[7] ..... A41D 19/00
(52) U.S. Cl. ..... 2/161.4; 2/16
(58) Field of Search ..... 2/160, 161.1, 161.2, 2/161.3, 163, 164, 16; 128/878, 879; 473/61, 62; 602/21, 22

(56) References Cited

U.S. PATENT DOCUMENTS 3,997,922 A 12/1976 Huhta
4,701,963 A 10/1987 Overton
4,709,694 A * 12/1987 O'Connell ..... 128/87
5,330,391 A * 7/1994 Mitchell ..... 473/59
5,435,007 A * 7/1995 Kalvestran et al. ..... 2/16
5,708,979 A 1/1998 Redwood et al.
5,740,555 A 4/1998 Renegar
5,761,745 A 6/1998 Sato
5,970,521 A * 10/1999 Rabbeth ..... 2/161.1
5,996,117 A * 12/1999 Goldsmith et al. ..... 2/16
6,010,473 A * 1/2000 Robinson ..... 602/21

FOREIGN PATENT DOCUMENTS

JP 61-9671 3/1986
JP 1-31252 9/1989
JP 5-51383 7/1993
JP 7-17276 3/1995

* cited by examiner

*Primary Examiner*—John J. Calvert
*Assistant Examiner*—Katerine Moran
(74) *Attorney, Agent, or Firm*—Troutman Sanders LLP; Gerald R. Boss

(57) ABSTRACT

In a sports glove (1) in which stretch fabric (2) is used in a back portion (1A) particularly subjected to extension force in holding a grip of a golf club or a baseball bat, an over-extension-preventing member (3A) is stitched to cover a part of the stretch fabric (2).

14 Claims, 9 Drawing Sheets

SPORTS GLOVE

This application is a continuation of International Application No. PCT/JP99/07308, with an international filing date of Dec. 24, 1999 which claims priority from Japanese Patent Application No. 11-8921 filed Jan. 18, 1999 and Japanese Patent Application No. 11-351334 filed Dec. 10, 1999.

This application claims priority based on PCT application PCT/JP99/07308 entitled "Sports Glove" which claims priority of Japanese patent applications having Serial Nos. 11-8921, filed Jan. 18, 1999 and application No. 11-351334 filed Dec. 10, 1999.

TECHNICAL FIELD

The present invention relates to a sports glove (athletic glove) in which stretch fabric is used, and more particularly to a sports glove having a portion preventing over extension of the stretch fabric to achieve better fit.

BACKGROUND ART

In the past, a number of gloves partly including stretch fabric have been proposed. For example, in Japanese Utility Model Publication No. 61-9671, a golf glove in which a highly stretching material is used for each fourchette is described. In Japanese Utility Model Publication No. 1-31252, a golf glove is disclosed in which stretching cloths are stitched across the region extending from bases of a little finger, a middle finger and a third finger of the back of a hand to an upper region of an index finger, on the strap-attaching side of the body of the hand, and a back portion of a thumb approximately up to its distal interphalangeal joint. In Japanese Utility Model Laying-Open No. 5-51383, a golf glove is disclosed in which a higher stretchable sheet material is used on the back portion rather than a palm portion and low-stretchable fabric is used on the periphery of the proximal end (the portion corresponding to the knuckle) of the thumb. Known sports glove is shown in FIG. 9, in that a portion particularly subjected to extension force is punched out or cut out from the end of fabric and stretch fabric is stitched thereon.

The golf gloves disclosed in Japanese Utility Model Publication Nos. 61-9671 and 1-31252 only emphasize the influence caused by a highly stretchable material or stretch fabric extending at the time of gripping a golf club. When one puts on a golf glove, he/she often pulls the wrist opening of the glove, and sometimes the stretch fabric stretches undesirably to prevent one from smoothly putting on the glove. When a player hits a ball, he/she firmly holds the grip, and the grip may slip due to the extension of the stretch fabric, impairing the feeling of perfect fit.

According to the golf glove disclosed in Japanese Utility Model Laying-Open No. 5-51383, only small gripping force is required to hold the grip of a golf club, and one can smoothly put on the glove because of low-stretchable fabric arranged on the periphery of the proximal end of the thumb, even when a wrist opening portion is pulled to put on the glove. However, since the entire back portion except for the periphery of the proximal end of the thumb is made of stretch fabric, the feeling of good fit at the time of hitting a ball may still be impaired.

The sports glove shown in FIG. 9 employs stretch fabric stitched only to the portions particularly subjected to the extension force in order to solve the problems described above. This, however, causes not only more difficult sewing due to its complicated design, but also possible impairment of the feeling of good fit due to the seams touching the hand.

DISCLOSURE OF INVENTION

The present invention is directed to a solution to the problems described above. An object of the invention is to provide a sports glove ensuring better fit, which can be made by a simple manufacturing method.

A sports glove according to the present invention includes stretch fabric at a part of a back (dorsal) portion thereof and an over-extension-preventing portion for preventing the stretch fabric from overly extending. The back portion herein refers to a portion located on the backside of the hand, including a portion continuously extending from a flat side of the hand (a palm) as long as it is located on the backside.

The over-extension-preventing portion is preferably stitched to the back portion so as to cover a part of the stretch fabric and a part of the back portion.

The over-extension-preventing portion may be formed of a member separated from the back portion or formed using a portion extending from the back portion.

Further, the over-extension-preventing portion preferably extends at least one direction from a longitudinal direction of each finger of the sports glove, a direction from a back wrist portion toward regions between each of the fingers, and a direction in which the fingers are aligned.

The stretch fabric may be arranged across metacarpophalangeal joints of a little finger to an index finger and along a metacarpal bone of the index finger. The over-extension-preventing portion then connects the back portions located on opposite sides of the stretch fabric to each other.

The sports glove includes an index finger base forming a knuckle portion of the index finger, a thumb base forming a knuckle portion of the thumb, and a wrist side portion located on the wrist side of the back portion. The over-extension-preventing portion may extend from a region between the index finger base and the thumb base to the wrist side portion.

In addition to the index finger base, the thumb base and the wrist side portion, the sports glove may also include a third finger base forming a knuckle portion of the third finger. The over-extension-preventing portion has a portion extending from the third finger base to the wrist side portion, a portion extending from the region between the index finger base and the thumb base to the wrist side portion, and a portion extending from the thumb base to the wrist side portion.

The sports glove may include the index finger base, the thumb base, the wrist side portion and also a middle finger base forming a knuckle portion of the middle finger. The over-extension-preventing portion has a portion extending from the middle finger base to the wrist side portion and a portion extending from the portion between the index finger base and the thumb base to the wrist side portion.

The stretch fabric includes a fingertip side portion stitched to portions of each finger from the little finger to the middle finger of the sports glove to cover proximal interphalangeal joints of the fingers. The over-extension-preventing portion is then stitched to at least one finger portion from the little finger to the middle finger, extending in its longitudinal direction so as to cover a part of the fingertip side portion.

The sports glove may include the index finger base, the wrist side portion, and a little finger base forming a knuckle portion of the little finger portion. The stretch fabric extends from a region just below the little finger base to the index finger base toward a curve connecting an upper portion of a metacarpal bone of the little finger with a lower portion of a metacarpal bone of the index finger. In this case, over-extension-preventing portion extends from a region below the index finger base to a region below the little finger base.

BEST MODE FOR CARRYING OUT THE INVENTION

Figure 1:
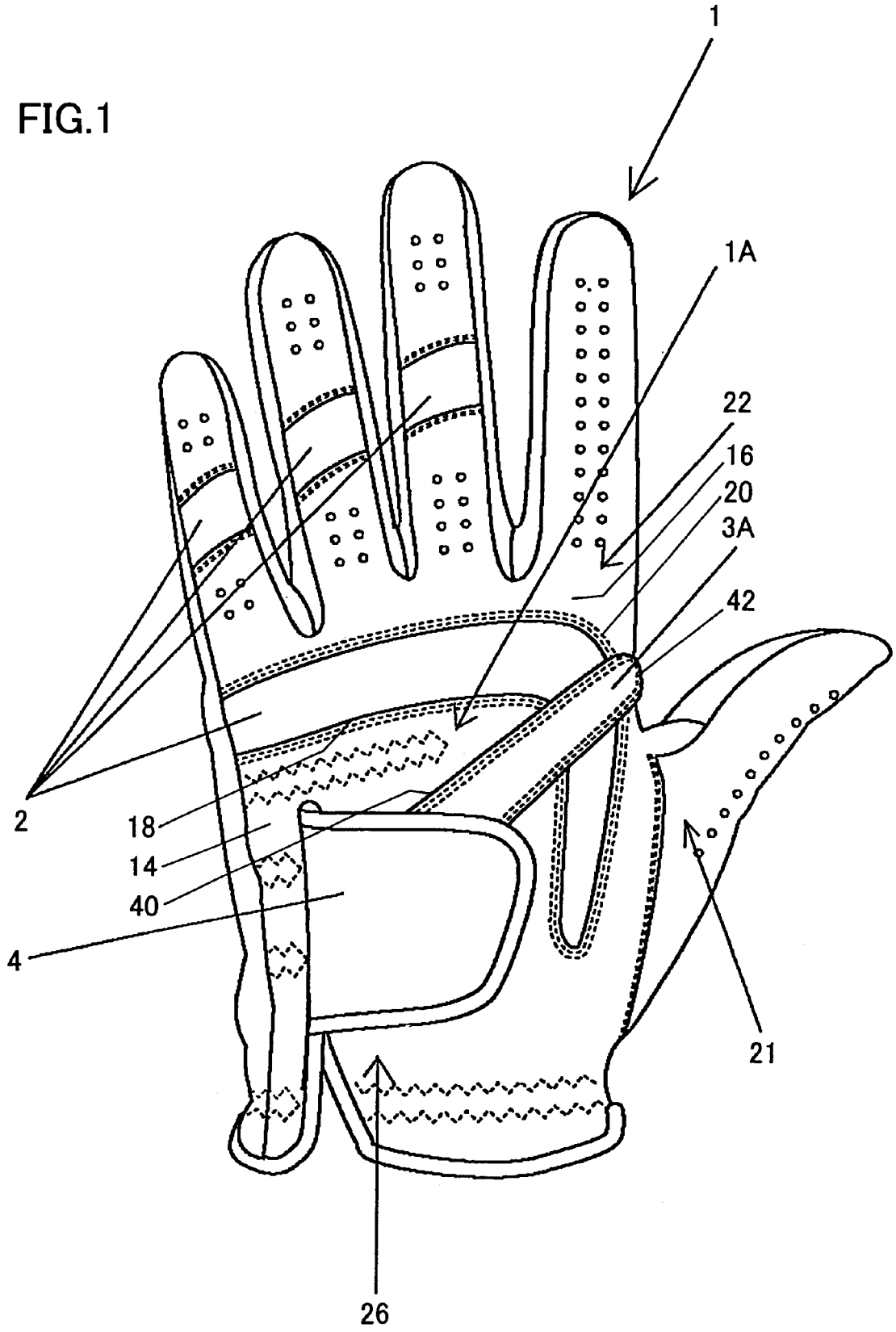
FIG. 1 is a plan view of the sports glove of the first embodiment.

A sports glove according to the present invention is mainly made of natural or artificial leather, a part of a back portion of a hand being stretch fabric, and an over-extension-preventing portion is employed for preventing the stretch fabric from extending more than necessary (over extension).

Examples of the over-extension-preventing portion are the one stitched to the back portion so as to cover a part of the stretch fabric, the one in which a part of the stretch fabric is made less stretching than other parts (low stretchable), and so on. It is noted that the over-extension-preventing member may be configured either separately from the back portion or using the part extending from the back portion.

Stretch fabric may be knit fabric and arranged, for example, across the metacarpophalangeal joints of the little finger to index finger and along the metacarpal bone of the index finger. The stretch fabric is also arranged in the portions along the proximal interphalangeal joints of the little finger through middle finger. In this way, the stretch fabric is arranged in the portion particularly subjected to extension force at the time of gripping.

It is noted that the stretch fabric of a material having good moisture absorbing/diffusing or perspiration-absorbing property, such as EVAL® (i.e., polyethylene vinyl alcohol) fiber, conjugated fiber of EVAL® and polyester, or perspiration-absorbing polyester fiber, is used in order to avoid dampness from perspiration.

The over-extension-preventing portion is configured of a member less stretchable than knit fabric or a member with high stretchability and elasticity, and is made of artificial leather, natural leather, synthetic leather, synthetic rubber, resin molded item or the like in an arbitrary shape.

When one hits a ball while holding the grip of a golf club, baseball bat or the like between the index finger and the thumb, the region from the index finger base forming the knuckle portion of the index finger to the thumb base forming the knuckle portion of the thumb is pulled toward a palm side. In order to suppress the extension of this portion, the over-extension-preventing portion may be provided to extend from the portion between the index finger base and the thumb base to the palm side.

Furthermore, to suppress the extension in the lengthwise direction in which the fabric stretches when the joints of the fingers are bent (longitudinal direction of each finger), it is preferable to provide the over-extension-preventing portion, in a manner such that the base forming the knuckle portion of each finger is connected to the portion located on the wrist side of the back of the hand (wrist side portion), or such that a fingertip side portions located closer to the fingertip than the proximal interphalangeal joint of each finger is connected to the wrist side portion. It is noted that the over-extension-preventing portion may be formed as a branch extending from the wrist side portion to the base of each finger.

In order to suppress extension in the lateral direction of the back portion (the direction in which fingers are aligned), the over-extension-preventing portion may be provided such that the base of the thumb is connected to the wrist side portion, or such that it extends from the index finger base to the little finger base.

First Embodiment

The present invention will be described below with reference to FIGS. 1 to 8.

Figure 2:
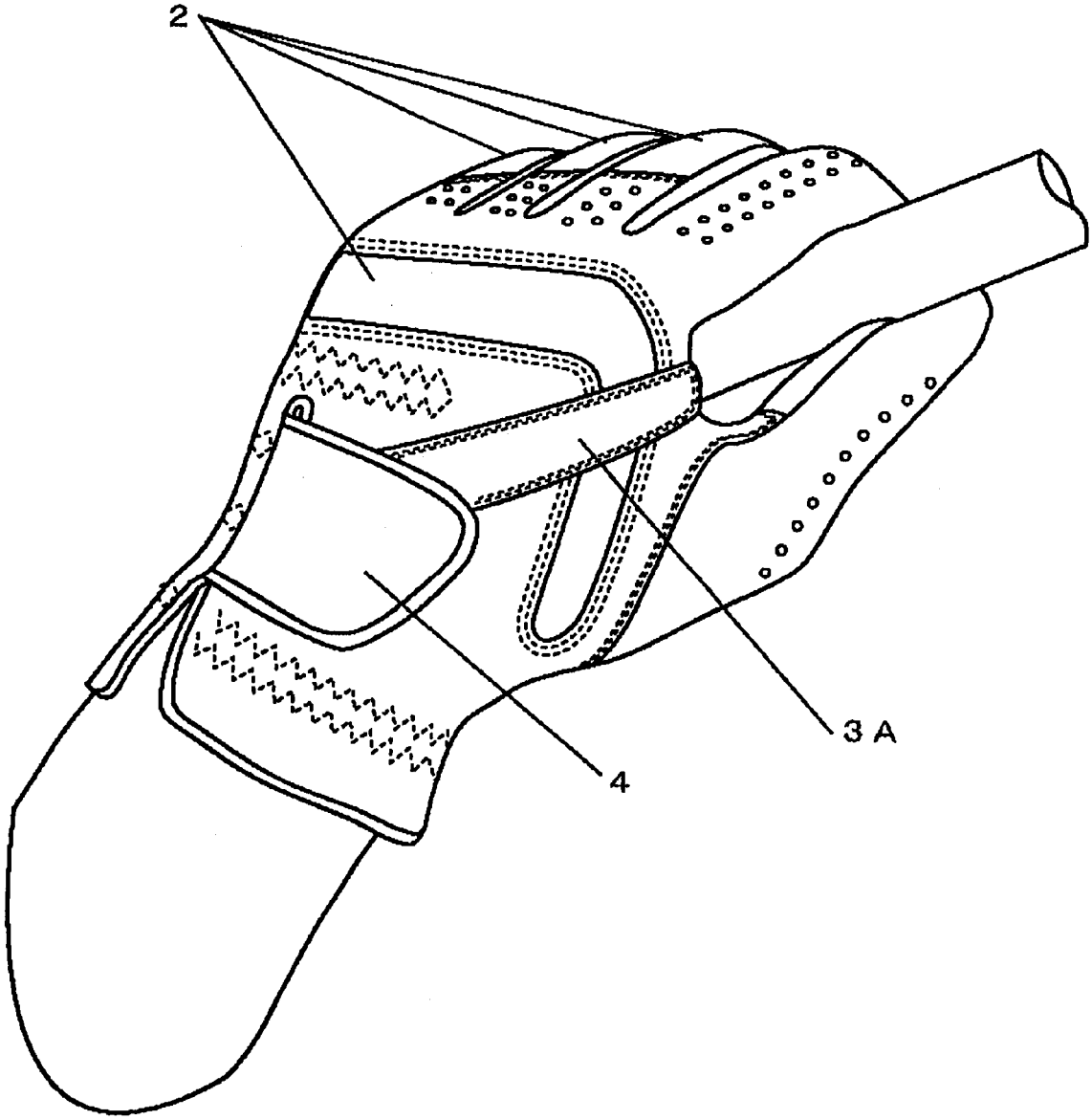
FIG. 2 is a perspective view showing the sports glove of the first embodiment gripping a golf club.
Figure 3:
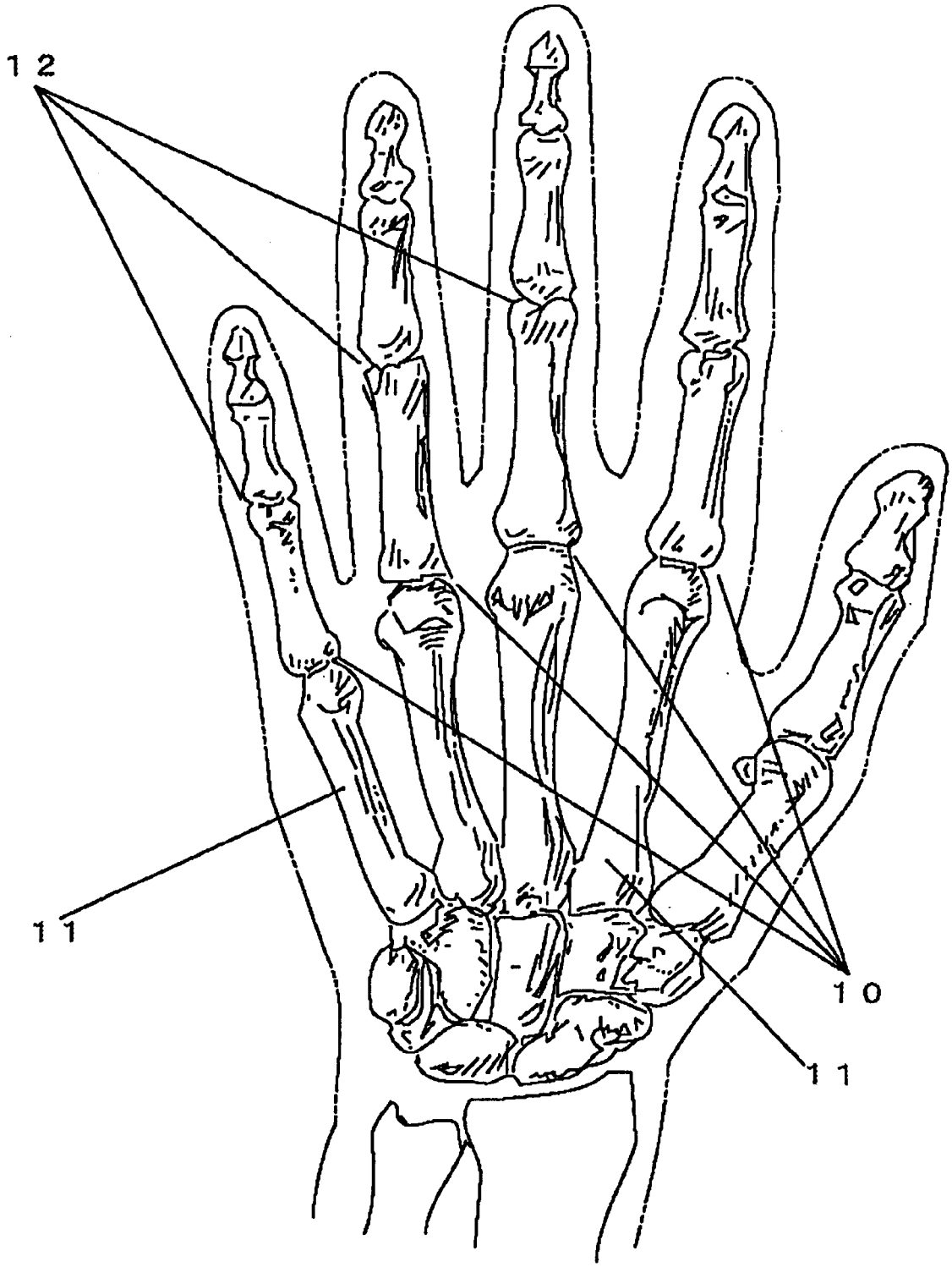
FIG. 3 is a skeleton view of a hand.

A sports glove 1 according to the first embodiment of the invention is shown in FIGS. 1 and 2. Sports glove 1 shown in the drawings includes a back portion 1A, stretch fabric 2 selectively stitched to back portion 1A, and an over-extension-preventing member 3A.

Back portion 1A is formed by cutting natural leather of main body material, and is sewn together with a palm portion. Stretch fabric 2 is stitched to back portion 1A, arranged in a portion corresponding to a proximal interphalangeal joint 12 of each of the little finger to middle finger shown in FIG. 3, a portion corresponding to a metacarpophalangeal joint 10 of each of little finger to index finger, and a portion corresponding to a metacarpal bone of the index finger.

Back portion 1A includes a first back portion 14 and a second back portion 16 which are offset. Stretch fabric 2 is affixed to back portion 1A in a manner such that stretch fabric 2 is disposed within the offset such that a first stretch 18 is located adjacent first back portion 14 and a second stretch edge 20 is located adjacent the second back portion 16. Over-extension-preventing member 3A includes a first end 40 and a second end 42. First end 40 is fixed to first back portion 14 and the second end 42 is fixed to the second back portion 16 such that over-extension-preventing member 3A traverses the offset and the stretch fabric preventing the stretch fabric from overly extending.

Over-extension-preventing member 3A is formed to have a belt-like shape, one end thereof being arranged between an index finger base 22 and a thumb base 21 and the other end on a wrist side portion 26, and extends over stretch fabric 2. An over-extension-preventing member 3A is stitched to back portion 1A, allowing the portion between index finger base 22 and thumb base 21 to be connected with wrist side portion 26.

The provision of over-extension-preventing member 3A suppresses the over extension of stretch fabric 2 when the sports glove 1 is put on or used, so that better fit of sports glove 1 can be attained. Moreover, since over-extension-preventing member 3A has a simple shape (linear shape in FIG. 1), stitching thereof is easy. Furthermore, there are fewer seams compared to the glove with a portion particularly subjected to extension force being punched out to stitch the stretch fabric thereon, so that poor fit due to the seams touching the hand can be avoided.

It is noted that, instead of providing over-extension-preventing member 3A, a portion of stretch fabric 2 located just below over-extension-preventing member 3A can be formed of a material having lower strechability or higher elasticity compared to the other parts of stretch fabric 2. In this case as well, the same effect can be expected as in the case of providing over-extension-preventing member 3A. This concept is applicable to each of the embodiments below.

A fitting strap 4 is attached, having a Hook and Loop fastener (Velcro®) stitched therewith, on a wrist side portion 26 of back portion 1 for easy put-on/take-off and tightening of sports glove 1.

Two-way tricot cloth of urethane fiber is used for the above-described stretch fabric 2, and natural leather, the main material of sports glove 1, is used for belt-shaped over-extension-preventing member 3A.

Second Embodiment

Figure 4:
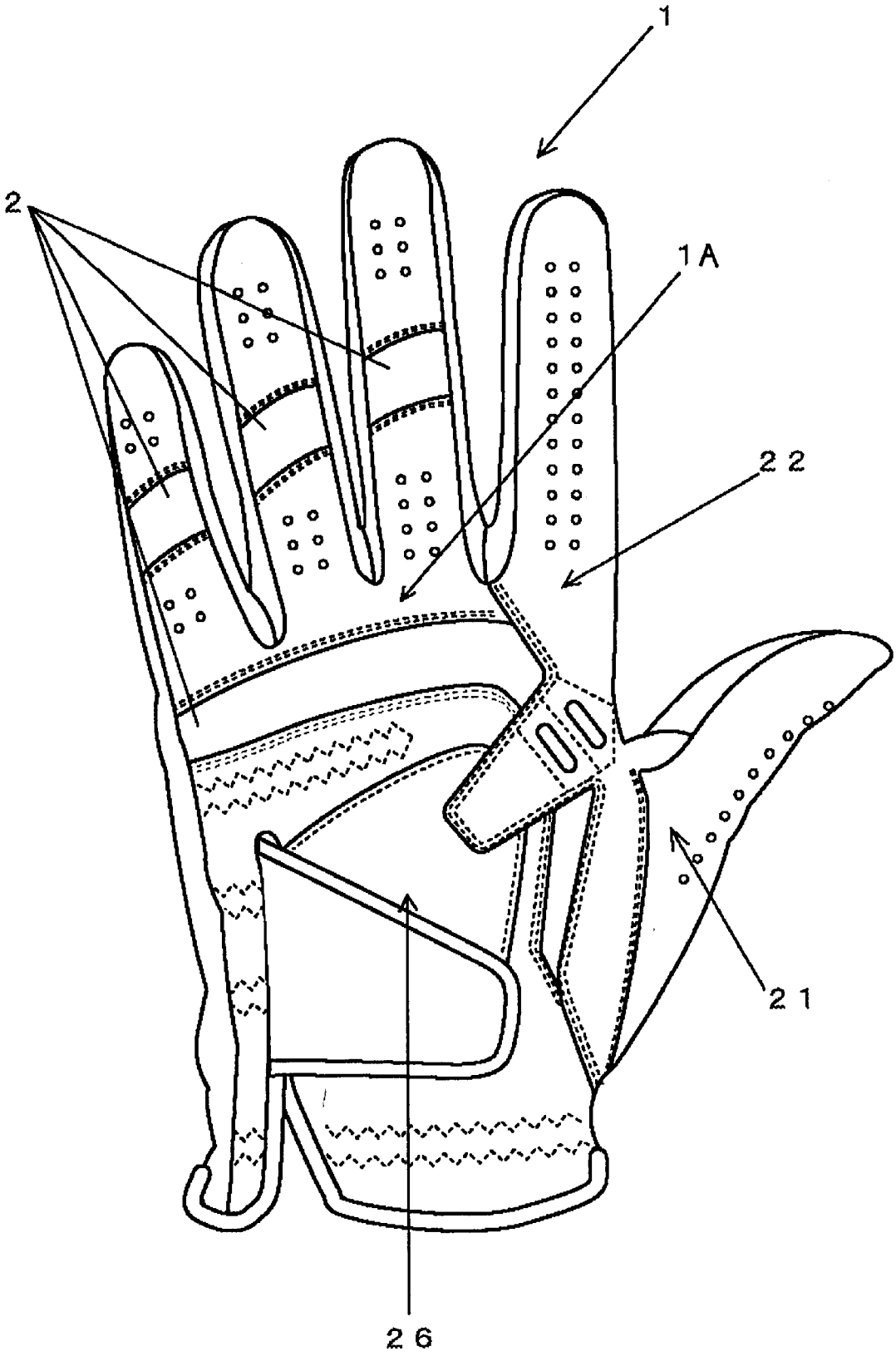
FIG. 4 is a plan view of the sports glove of the second embodiment.

The second embodiment of the present invention is now described with reference to FIG. 4. In sports glove 1 of the second embodiment shown in FIG. 4, an index finger portion is formed of the main material of the palm side by bringing it over to the back side, and an over-extension preventing portion is formed by extending the index finger base 22 which forms the proximal end (knuckle portion) of the index finger to wrist side portion 26. In other words, the over-extension-preventing portion is formed by cutting the main material of the palm side to have a portion extending from index finger base 22 toward wrist side portion 26. It is noted that the above-described portion extending from the main material of the palm side (over-extension preventing portion) can be expected to have the same effect as over-extension preventing member 3A, if it extends out from the portion located between index finger base 22 and thumb base 21 toward wrist side portion 26.

Further, though it is not shown in the drawings, the extending portion described above may also be formed by cutting the fabric such that wrist side 26 extends toward the region between index finger base 22 and thumb base 21.

Third Embodiment

The third embodiment of the present invention is now described with reference to FIG. 5. Trichotomous over-extension preventing member 3B is stitched on sports glove 1 of the third embodiment shown in FIG. 5. Over-extension preventing member 3B of the same shape as that of the first embodiment extends on stretch fabric 2, having a first portion extending from wrist side portion 26 to a third finger base 24, a second portion extending from wrist side portion 26 to the region between index finger base 22 and thumb base 21, and a third portion extending from wrist portion 26 to thumb base 21.

The above-described first portion has one end at third finger base 24 and the other end at the wrist side portion 26, the second portion has one end at the region between index finger base 22 and thumb finger base 21 and the other end at wrist side portion 26, and the third portion has one end on thumb base 21 and the other end on wrist side portion 26.

Figure 5:
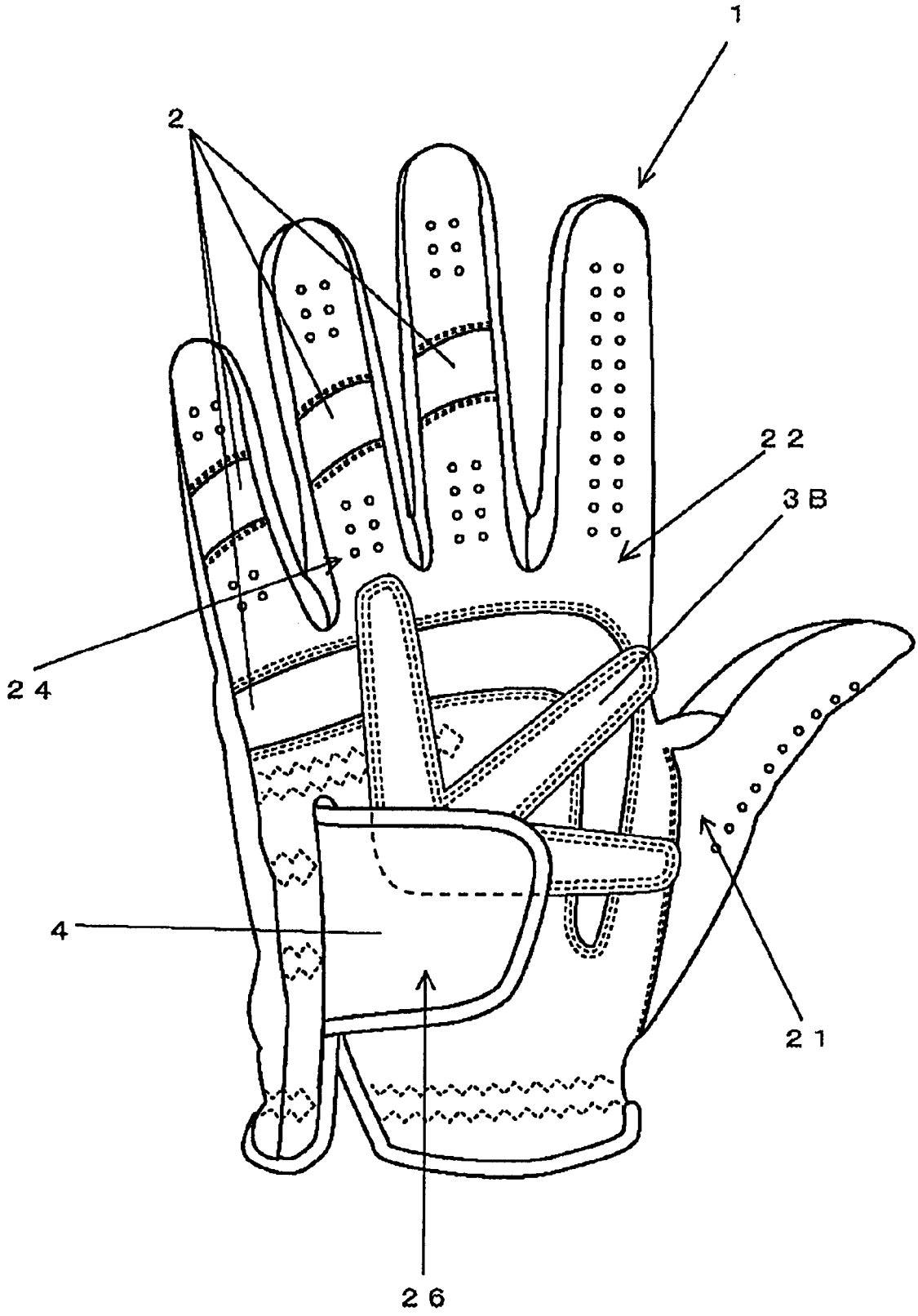
FIG. 5 is a plan view of the sports glove of the third embodiment.

Over-extension preventing member 3B having a shape as described above enables suppression of over extension of stretch fabric 2, at the time of gripping, in lengthwise direction of sports glove 1 (extending direction of the fingers, i.e., top-to-bottom direction in FIG. 5) and in lateral direction (direction in which fingers are aligned, i.e., left-to-right direction in FIG. 5), and at the time of hitting a ball, in diagonal direction from the portion between the index finger and the thumb toward wrist side portion 26.

It is noted that, though over-extension-preventing members 3B extend out in the above three directions from wrist side portion 26 in the present embodiment, it is also possible to have over-extension-preventing members extending in two of the above three directions and a belt-shaped over-extension-preventing member extending in the remaining direction, or to provide three belt-shaped over-extension-preventing members respectively extending in the three directions above.

Fourth Embodiment

Figure 6:
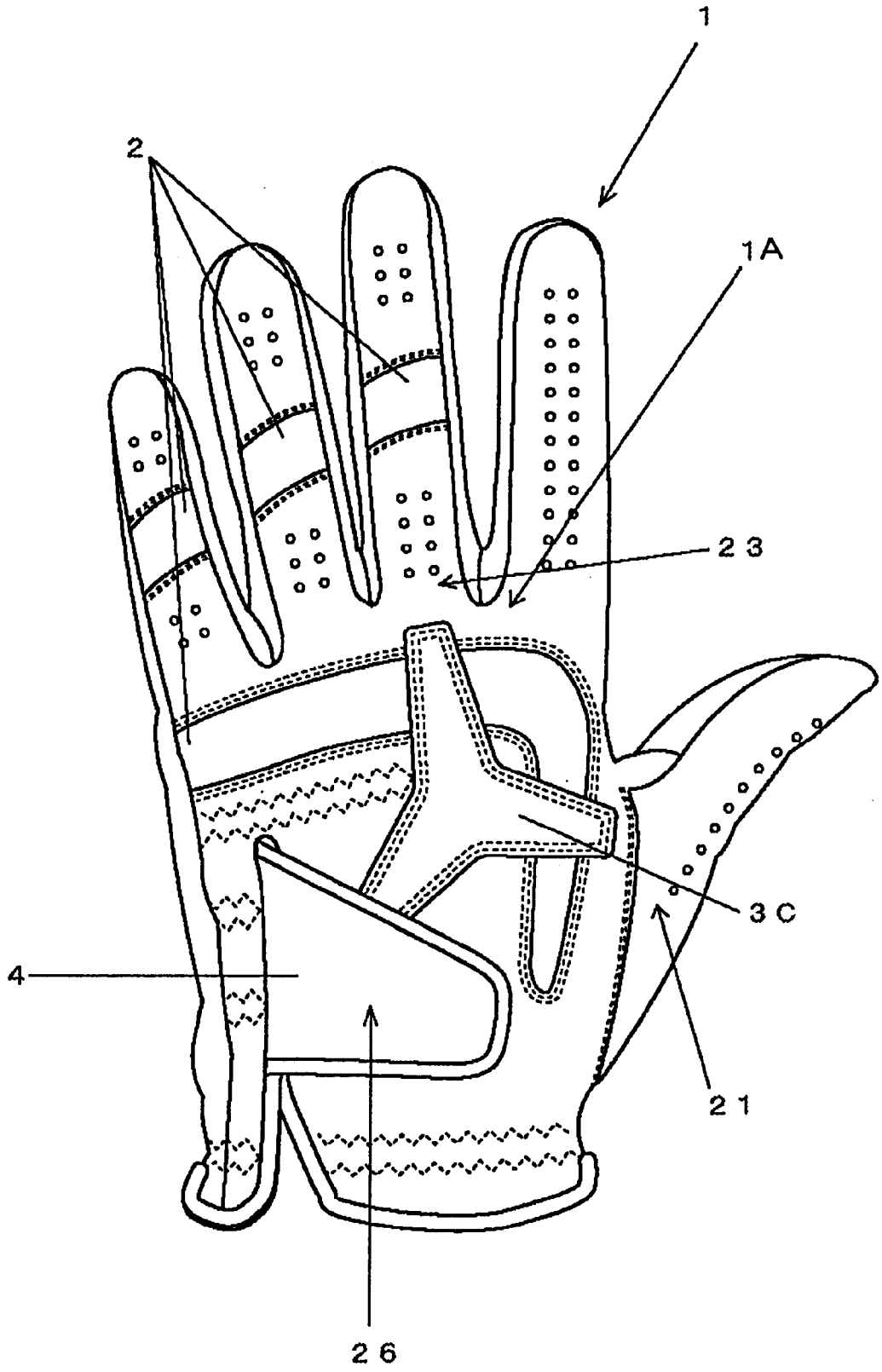
FIG. 6 is a plan view of the sports glove of the fourth embodiment.

The fourth embodiment of the present invention is now described with reference to FIG. 6. Sports glove 1 of the fourth embodiment shown in FIG. 6 includes stretch fabric 2 of the same shape as that of the first embodiment and a Y-shaped over-extension-preventing member 3C.

Over-extension-preventing member 3C has a portion extending from a middle finger base 23 via stretch fabric 2 to wrist side portion 26 and a portion extending from the region between index finger base 22 and thumb base 21 via stretch fabric 2 to wrist side portion 26, and is stitched to back portion 1A. The above-described arrangement also allows the effect similar to sports glove 1 of the third embodiment to be attained.

Fifth Embodiment

Figure 7:
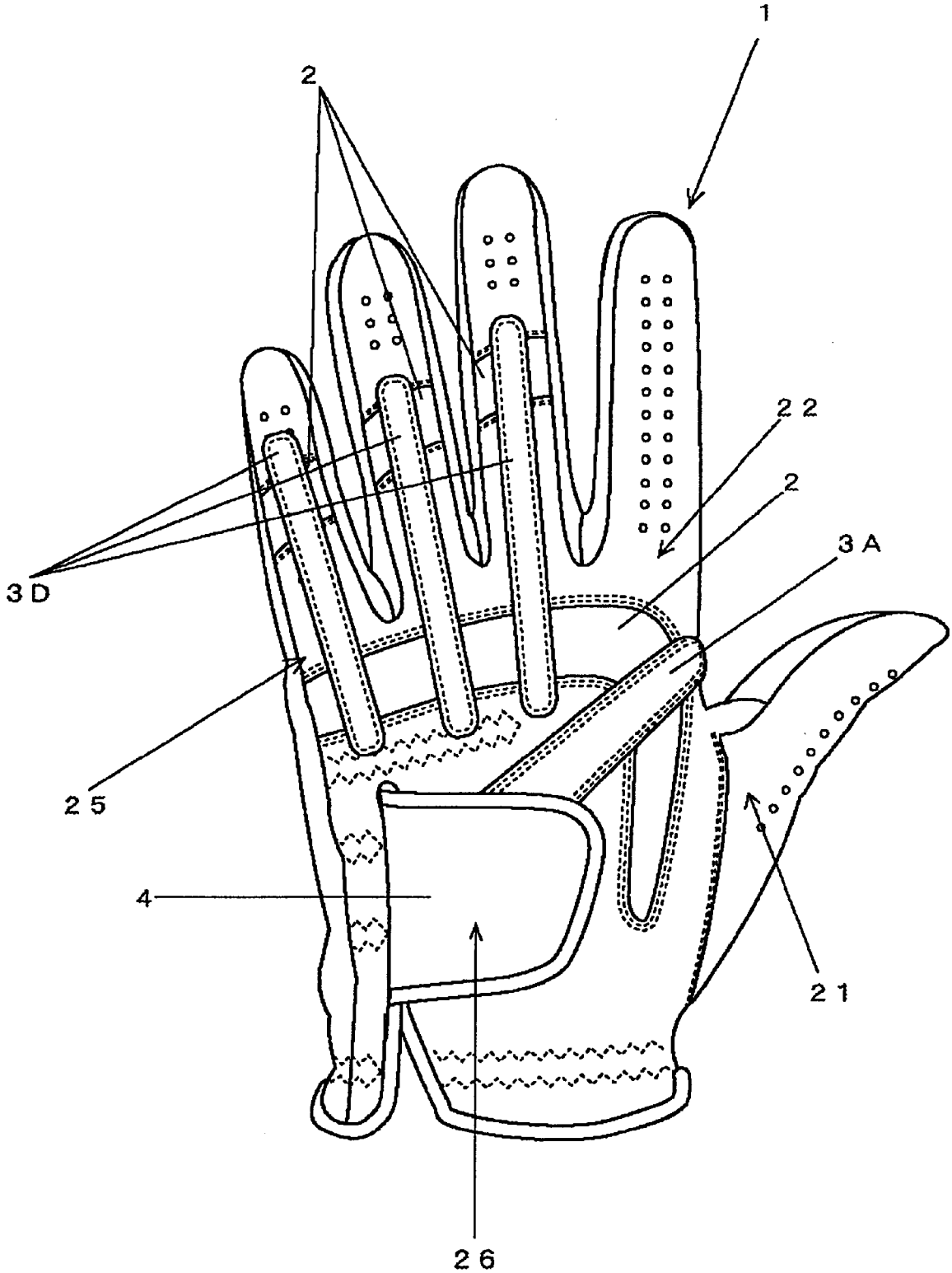
FIG. 7 is a plan view of the sports glove of the fifth embodiment.

The fifth embodiment of the present invention is now described with reference to FIG. 7. Sports glove 1 of the fifth embodiment shown in FIG. 7 includes stretch fabric 2 of the same shape as that in the first embodiment, and belt-shaped over-extension-preventing members 3A and 3D.

Over-extension-preventing members 3D each extends from a part of back portion 1A closer to the fingertips than proximal interphalangeal joint 12 of the little finger to middle finger (fingertip portion), via stretch fabric 2 stitched to each finger (fingertip side portion), the base of each finger including a little finger base 25 and stretch fabric 2 located just below the base of each finger, to wrist side portion 26, and reaches a part of wrist side portion 26 located below metacarpophalangeal joint 10. This means that over-extension-preventing members 3D are stitched to back portion 1A such that they run down from one stretch fabric 2 to the other in the longitudinal directions of the little finger to middle finger respectively.

The shape of over-extension-preventing member 3A is similar to that of the first embodiment. The provision of over-extension-preventing members 3D more effectively suppresses over extension in the longitudinal direction of stretch fabric 2.

Sixth Embodiment

Figure 8:
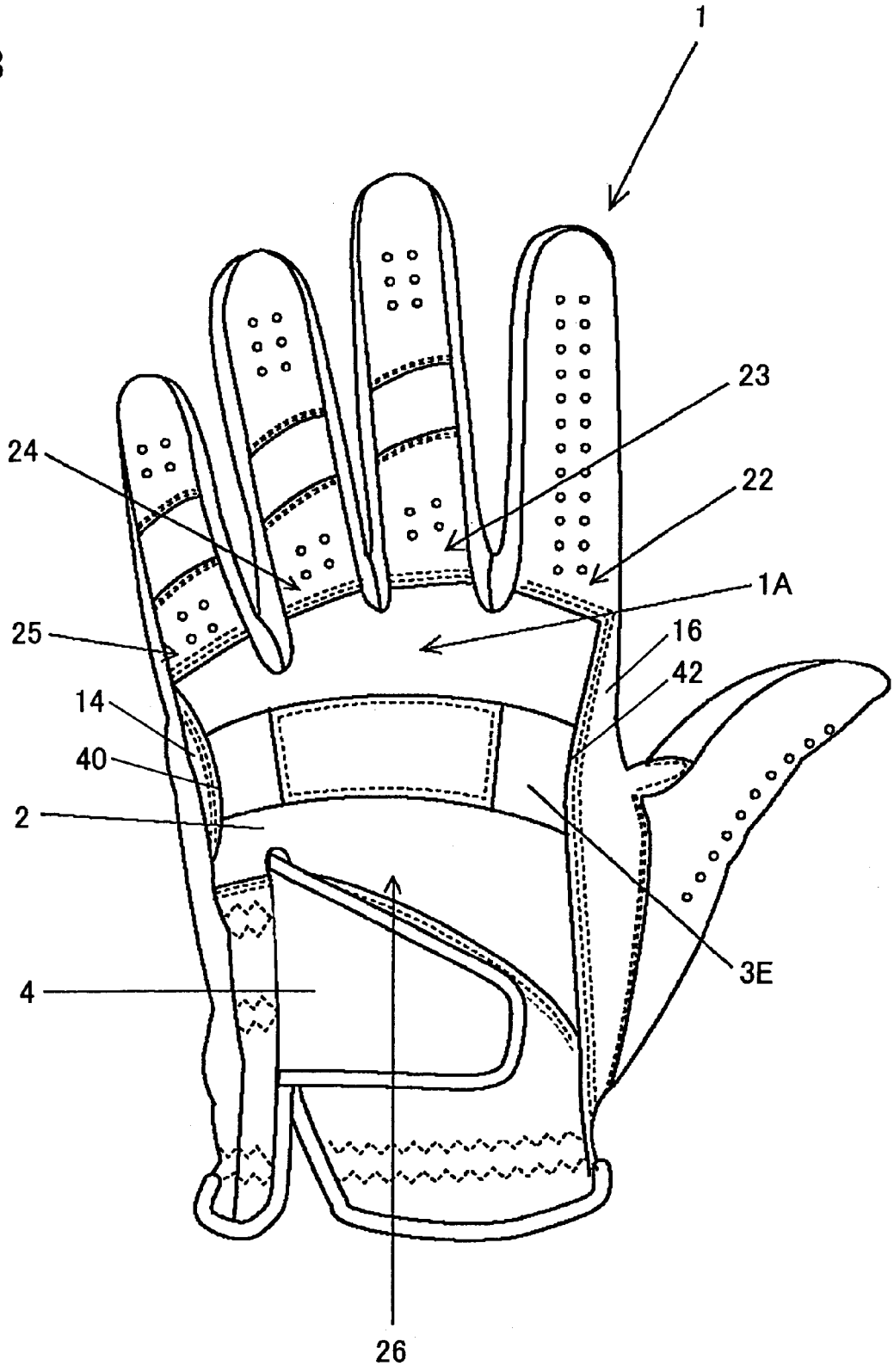
FIG. 8 is a plan view of the sports glove of the sixth embodiment.
Figure 9:
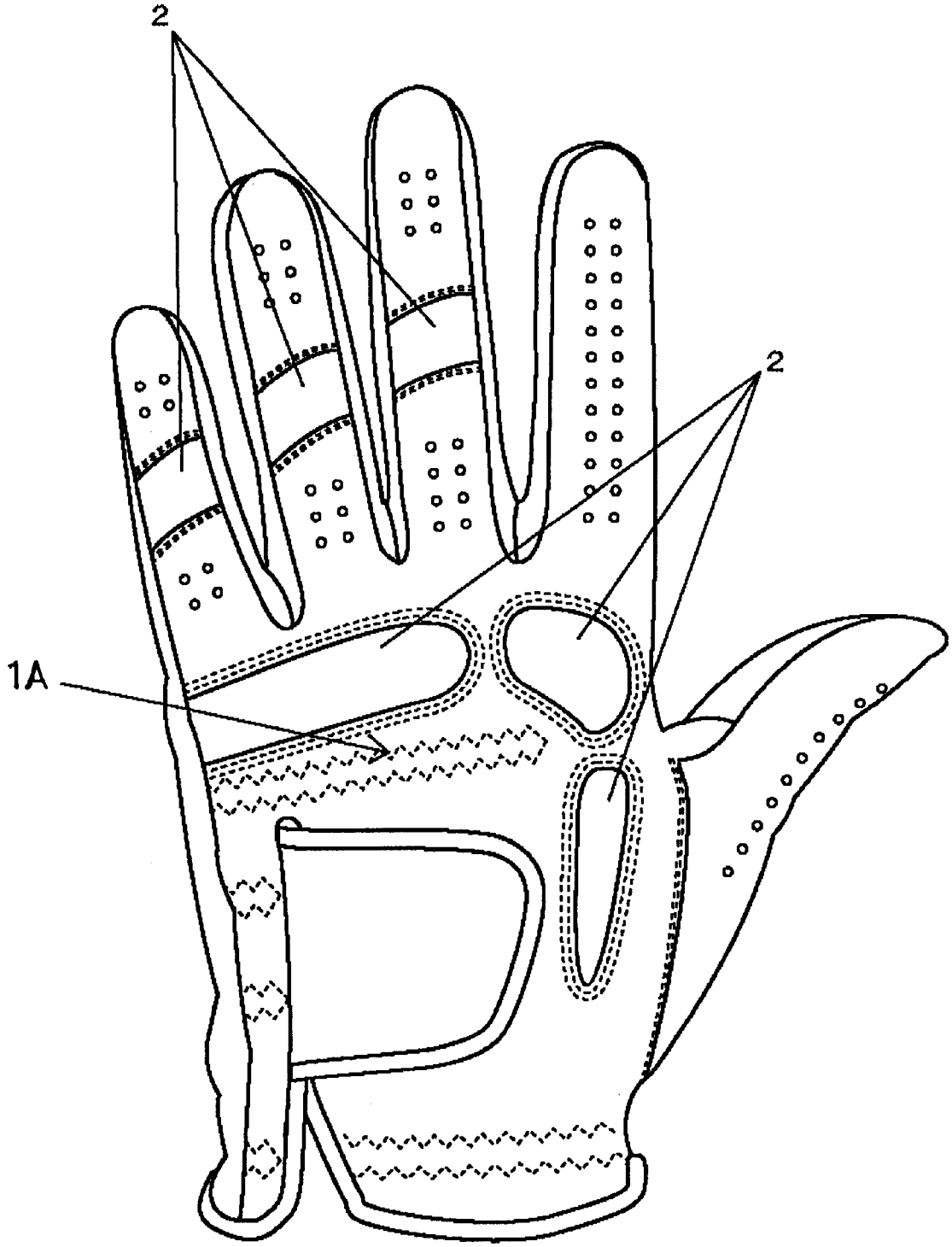
FIG. 9 PRIOR ART
FIG. 9 is a plan view of a conventional sports glove.

The sixth embodiment of the present invention is now described with reference to FIG. 8. Sports glove 1 of the sixth embodiment shown in FIG. 8 includes stretch fabric 2 and belt-shaped over-extension-preventing member 3E.

Stretch fabric 2 is formed of knit fabric made of conjugated yarn of EVAL® fiber and polyester fiber, having an upper end portion including upper parts of little finger base 25 to index finger base 22, and extending therefrom down to the curve connecting upper metacarpal bone 11 of the little finger to lower metacarpal bone 11 of the index finger. That is, in the present embodiment, stretch fabric 2 extends in a region wider than that in any of the embodiments above, the upper part of wrist side portion 26 also being formed of stretch fabric 2.

Over-extension-preventing member 3E is then provided such that it extends, in right-to-left direction, over approximately central portion of stretch fabric 2. The both ends of this over-extension-preventing member 3E extending in right-to-left direction are stitched to back portion 1A, whereas the other portions of the member is not stitched to stretch fabric 2.

The above-described arrangement suppresses over extension of stretch fabric 2 in right-to-left direction while avoiding dampness from perspiration in wrist side portion 26.

Further, as in the case of the present embodiment, when a gap is provided by leaving unstitched the portions where belt-shaped over-extension-preventing member 3E covers stretch fabric 2, the air permeability of this portion is secured, further preventing the dampness from perspiration.

The present invention provides such effects as follows because of the configuration described above.

Since the over-extension-preventing portion is provided, the stretch fabric can be prevented from overly extending when one holds the grip of a golf club or a baseball bat wearing the sports glove according to the present invention, and also the sports glove can be easily put on. Moreover, even if a strong impact or a twist is added upon hitting a ball, the stretch fabric would not overly extend, which prevents the grip from slipping and ensures good fit.

The manufacturing of over-extension-preventing portion described above is easy, because it can be formed, for example, only by stitching a member of a simple shape such as a linear shape to the back portion so as to cover the stretch fabric provided in the portion particularly subjected to extension force.

Further, while achieving the simple manufacturing as described above, the sports glove according to the present invention can attain the same or even better effect compared to a sports glove having a complicated configuration such as the one with back portion being partly punched out or cut out for stitching stretch fabric thereon.

Moreover, since the over-extension-preventing portion can be arranged at any desired position with any desired size, the design for ensuring various fits can readily be realized.

The over-extension-preventing portion can also give an impression that one can securely hit a ball. Further, it allows the glove to have better design by providing printings, embroidery or the like thereon, or by using a member different in its material or color from the stretch fabric and the main body material for the over-extension-preventing portion.

Furthermore, the use of the stretch fabric of highly moisture absorbing/diffusing or perspiration-absorbing material at the upper part of the wrist side of the back portion, the dampness due to perspiration in the upper wrist portion can be avoided.

INDUSTRIAL APPLICABILITY

The present invention is advantageously applicable to sports gloves.

What is claimed is:

1. A sports glove comprising:

a first back portion;

a second back portion defining an offset with said first back portion;

a stretch fabric intermediary said first and said second back portions disposed within said offset; and an over-extension-preventing portion for preventing the stretch fabric from overly extending;

said over-extension-preventing portion having a first end fixed to said first back portion and a second end opposite said first end fixed to said second back portion traversing said offset and said stretch fabric thereby preventing said stretch fabric from overly extending.

2. The sports glove according to claim 1, wherein said over-extension-preventing portion is secured to said either of said first or said second back portion (1A) and releaseably secured to the other of said first or said second back portion.

3. The sports glove according to claim 1, wherein said over-extension-preventing portion is formed by a portion extending from said back portion (1A).

4. The sports glove according to claim 1, wherein said over-extension-preventing portion includes an over-extension-preventing member (3A to 3E) formed of a member separated from said back portion (1A).

5. The sports glove according to claim 1, wherein said over-extension-preventing portion extends at least one direction from a longitudinal direction of each finger of said sports glove, a direction extending from a region located on a wrist side of said back portion (1A) to a region between each of said fingers, and a direction in which said fingers are aligned.

6. The sports glove according to claim 1, including an index finger base (22) forming the knuckle portion of the index finger, a thumb base (21) forming the knuckle portion of the thumb, a third finger base (24) forming a knuckle portion of the third finger, and a wristside portion (26) located on the wrist side of said back portion (1A), said over-extension-preventing portion having a portion extending from said third finger base (24) to said wrist side portion (26), a portion extending from the region between said index finger base (22) and thumb base (21) to said wrist side portion (26), and a portion extending from said thumb base (21) to said wrist side portion (26).

7. The spores glove according to claim 1, including an index finger base (22) forming the knuckle portion of the index finger, a thumb base (21) forming the knuckle portion of the thumb, a middle finger base (23) forming the knuckle portion of the middle finger, and a wrist side portion (26) located on the west side of said back portion (1A), said over-extension-preventing portion having a portion extending from said middle finger base (23) to said wrist side portion (26) and a portion extending from the region between said index finger base (22) and a portion extending from the region between said index finger base (22) and said thumb base (21) to said wrist side portion (26).

8. The sports glove according to claim 1, wherein said stretch fabric (2) includes a fingertip side portion stitched to each of little finger to middle finger of said sports glove across each proximal interphalangeal joint (12) of little finger to middle finger, said over-extension-preventing portion being stitched to extend in its longitudinal direction onto at least one of said little finger to said middle finger so as to cover a part of said fingertip portion.

9. The sports glove according to claim 1 including an index finger base (22) forming a knuckle portion of the index finger, a little finger base (25) forming a knuckle portion of the little finger, and a wrist side portion (26) located on a wrist side of said back portion (1A), said stretch fabric (2) extending from a region just below said little finger base (25) through said index finger base (22) to a curve connecting an upper portion of a metacarpal bone (11) of the little finger to a lower portion of a metacarpal bone (11) of the index finger.

10. The sports glove according to claim 9, wherein said over-extension-preventing portion extends from a portion below said index finger base (22) to a portion below said little finger base (25).

11. A sports glove having stretch fabric (2) as a part of a back portion (1A) comprising:

said stretch fabric (2) is arranged across metacarpophalangeal joints (10) of little finger to index finger and along metacarpal bone (11) of the index finger, and an over-extension-preventing portion for preventing the stretch fabric (2) from overly extending is provided;

said over-extension-preventing portion connects parts of said back portion (1A) located on opposing sides of said stretch fabric (2) with each other.

12. A sports glove having stretch fabric (2) as a part of a back portion (1A), including:

an index finger base (22) forming a knuckle portion of the index finger;

a thumb base (21) forming a knuckle portion of the thumb;

a wrist side portion (26) located on the wrist side of said back portion (1A);

an over-extension-preventing portion for preventing the stretch fabric (2) from overly extending;

said over-extension-preventing portion extends from a region between said index finger base (22) and said thumb base (21) to said wrist side portion (26).

13. A sports glove comprising:

a back portion having stretch fabric;

a palm side portion comprising of main material;

an index finger portion being formed of said main material;

said index finger portion including an index finger base;

a wrist portion; and an over-extension preventing portion formed by extending said index finger base to said wrist side portion for preventing over-extension of said stretch fabric.

14. A sports glove according to claim 13 with said over-extension preventing portion formed by cutting said main material of said palm side to have a portion extending from said index finger base towards said wrist side portion.

* * * * *